US007628455B2

(12) United States Patent
Brodeur

(10) Patent No.: US 7,628,455 B2
(45) Date of Patent: Dec. 8, 2009

(54) ADJUSTABLE CROSS-LEGGED SUPPORT SEAT

(76) Inventor: Carl Christopher Brodeur, 436 Muskrat Street, P.O. Box 148, Banff, AB (CA) T1L 1A3

( * ) Notice: Subject to any disclaimer, the term of this patent is extended or adjusted under 35 U.S.C. 154(b) by 33 days.

(21) Appl. No.: 11/588,535

(22) Filed: Oct. 27, 2006

(65) Prior Publication Data

US 2007/0126271 A1 Jun. 7, 2007

Related U.S. Application Data

(63) Continuation-in-part of application No. 11/056,460, filed on Feb. 11, 2005, now abandoned.

(60) Provisional application No. 60/543,678, filed on Feb. 12, 2004.

(51) Int. Cl.
*A47C 7/50* (2006.01)

(52) U.S. Cl. ..... 297/423.1; 297/284.9; 297/312

(58) Field of Classification Search ..... 297/284.9, 297/284.3, 284.1, 338, 339, 344.12, 353, 297/312

See application file for complete search history.

(56) References Cited

U.S. PATENT DOCUMENTS

| | | | | | |
|---|---|---|---|---|---|
| 3,679,257 | A | * | 7/1972 | Jacuzzi et al. | 297/42 |
| 3,773,382 | A | * | 11/1973 | Coursault et al. | 297/284.9 |
| 3,890,004 | A | | 6/1975 | Rail | |
| 4,653,805 | A | * | 3/1987 | Maloney | 297/284.9 |
| 4,673,216 | A | | 6/1987 | Alfer | |
| 4,832,406 | A | * | 5/1989 | Adams et al. | 297/353 |
| 5,029,350 | A | | 7/1991 | Edelson | |
| 5,134,740 | A | | 8/1992 | Summer | |
| 5,167,435 | A | * | 12/1992 | Aldi | 297/312 |
| 5,374,109 | A | | 12/1994 | Wortman | |
| 5,490,717 | A | | 2/1996 | Greene | |
| 5,496,092 | A | * | 3/1996 | Williams et al. | 297/250.1 |
| 5,580,128 | A | * | 12/1996 | Johnson et al. | 297/312 |

(Continued)

FOREIGN PATENT DOCUMENTS

| | | |
|---|---|---|
| CN | 2093565 U | 1/1992 |

(Continued)

OTHER PUBLICATIONS

Supplementary European Search Report for EP Counterpart Patent No. 05706482.6 (Oct. 6, 2008).

(Continued)

*Primary Examiner*—Sarah B McPartlin
(74) *Attorney, Agent, or Firm*—Blakely, Sokoloff, Taylor & Zafman LLP

(57) ABSTRACT

A seating device for allowing a user to sit in either a cross-legged yoga position or in a conventional manner, the seating device including leg supports which can be adjusted into a variety of positions to supporting a user's legs when sitting cross-legged in a variety of places to accommodate the user's comfort level. The seat may also have an attached back support. In another embodiment the apparatus includes a seat having a surface area wide enough to allow a user to sit on the seat in a cross-legged position and having a contoured front to allow a user's legs to hang comfortably over the front of seat while the user sits in a conventional manner.

16 Claims, 9 Drawing Sheets

U.S. PATENT DOCUMENTS

| | | | | | |
|---|---|---|---|---|---|
| 5,597,203 | A | * | 1/1997 | Hubbard | 297/284.3 |
| 5,605,379 | A | | 2/1997 | Weiss | |
| 5,681,083 | A | * | 10/1997 | Nelson et al. | 297/284.3 |
| 5,713,632 | A | * | 2/1998 | Su | 297/312 |
| 5,876,098 | A | | 3/1999 | Conaway et al. | |
| 6,659,553 | B2 | * | 12/2003 | Achleitner et al. | 297/284.9 |
| D496,803 | S | | 10/2004 | Bjurman | |
| 6,840,577 | B2 | * | 1/2005 | Watkins | 297/284.9 |
| 6,893,090 | B1 | * | 5/2005 | Van Deursen et al. | 297/312 |

FOREIGN PATENT DOCUMENTS

| | | | | |
|---|---|---|---|---|
| CN | 2180127 | Y | | 10/1994 |
| CN | 2513452 | Y | | 10/2002 |
| DE | 196 05 779 | A1 | | 7/1996 |
| FR | 2769813 | | | 4/1999 |
| JP | 06072218 | A | * | 3/1994 |
| JP | 7204059 | | | 8/1995 |
| WO | WO 03/068114 | A1 | | 8/2003 |

OTHER PUBLICATIONS

Search Report, "International Searching Authority", (May 25, 2005),11 pgs.

Zen By Design—The Dhyana Chair, "Zen By Design Presents Furniture For The Spirit", (May 25, 2005),1 pg.

PCT Report and Written Opinion for PCT Application No. PCT/CA 2005/000174, mailing date May 25, 2005, 12 pages.

Zen By Design—The Dhyana Chair, "Zen by Design Presents Furniture for the Spirit", (May 25, 2005), 1 page.

* cited by examiner

ADJUSTABLE CROSS-LEGGED SUPPORT SEAT

CROSS-REFERENCE TO RELATED APPLICATIONS

This application is a continuation in part of U.S. application Ser. No. 11/056,460, filed Feb. 11, 2005 now abandoned, claiming priority from U.S. Provisional Application Ser. No. 60/543,678, filed Feb. 12, 2004.

FIELD OF THE INVENTION

The present invention relates to a seat for supporting a user sitting in a cross-legged yoga position. More particularly, the present invention includes a seat having leg supports which can be adjusted by a user through a range of motion thereby offering varying levels of support for a user's legs to accommodate according to a user's comfort level while sitting in a cross-legged yoga position.

BACKGROUND OF THE INVENTION

Chairs are used by many people every day without much second thought. However, the effects of chair use are profound, both mentally and physically. Many physical and mental aliments, including depression, lower back pain and arthritis can be attributed to the regular use of chairs.

Meditation and yoga are becoming more and more common in North America and these practices have been proven to benefit those practicing them as well as those around them; such practices include sitting cross-legged which is more common globally than sitting in chairs for the simple economic reason that many people cannot afford to buy chairs. Unfortunately, conventional North American chairs do not take advantage of these practices.

There are many inventions pertaining to aiding one to sit in a cross-legged position. However, most of these devices are comprised of a cushion or wooden platform that is placed at floor level or just slightly above, such as U.S. Pat. Nos. 5,374,109,5,876,098, 5,490,717, 4,673,216, 5,029,350, 5,134,740, 3,890,004, French Patent 2769813 and Japanese Patent 7204059A2. While the devices taught by these patents are useful for meditation while sitting on the floor they are not a practical tool in an environment designed around chairs.

A further cross-legged sitting device is taught in U.S. Pat. No. 5,605,379 which discloses a chair with its seat adapted to allow a user to sit in a cross-legged position. However, this simple device does not offer the versatility of the present invention.

Accordingly, in view of the prior art, it is desirable to provide a versatile seat for allowing a user to sit in a cross-legged yoga position in any environment such as an office, home, school and restaurant and which will accommodate a variety of users to overcome the shortcomings of and improve upon the prior art.

SUMMARY OF THE INVENTION

The present invention is intended to blend the skills and insight of eastern and western cultures by allowing conventional North American chairs and seating to take advantage of the practices of meditation and yoga. The present invention combines the functionality of conventional chairs' heights which is suitable for use in a plurality of environments typically found in North America with an effective adjustable support system to allow a user to sit in a cross-legged position to experience the benefits of sitting in a meditation or yogic meditation or exercise posture.

It is an object of the present invention to provide a seat for allowing a user to sit in a cross-legged yoga position including a seat having leg support members for providing support for each of a user's legs while the user sits in a cross-legged position, and two adjustable arms, each adjustable arm connected to the seat and a leg support member for allowing a user to adjust the position of each leg support member according to the user's comfort level. The seat 11 is attached to a support base or may optionally include a support base.

It is another object of the present invention to provide a seat having a surface area wide enough to allow a user to sit on the seat in a cross-legged position, the seat having contours in the front to allow a user's legs to hang comfortably over the front of seat while the user sits in a conventional manner. Such a seat provides flexibility by allowing a user (or different users) to sit in one of two positions thereby enhancing the versatility of the seat and its suitability for use in a broad range of environments for a broad range of users.

It is a further object of the present invention to teach a seat which has the qualities necessary for use in a broad variety of environments (including use in an office environment (such as in offices and boardrooms), schools, homes, and generally anywhere where chair use is prevalent). Further, the present invention can accommodate a wide variety of users, from advanced practitioners of yoga and meditation to absolute beginners.

In one embodiment, the present invention includes a seat which accommodates a user sifting in a cross-legged meditation or yogic meditation or exercise posture or which is equally capable of supporting the user sifting in a conventional manner.

In another embodiment, the present invention employs a highly effective method of adjusting the leg support members, allowing a user to select the desired angle of thigh support when sifting in a cross-legged position.

The present invention may also include a fully adjustable or fixed back support connected to the rear of the seat for providing back support to the user.

The seat may be connected to any form of suitable support base ordinarily used for chair's and seating. Optionally, the present invention may include both a seat and a base.

Other aspects and features of the present invention will become apparent to those ordinarily skilled in the art upon review of the following description of specific embodiments of the present invention.

BRIEF DESCRIPTION OF THE DRAWINGS

The present invention will be described in more detail below with reference to the accompanying drawings which are provided by way of example only, in which.

DETAILED DESCRIPTION OF THE INVENTION

Figure 1:
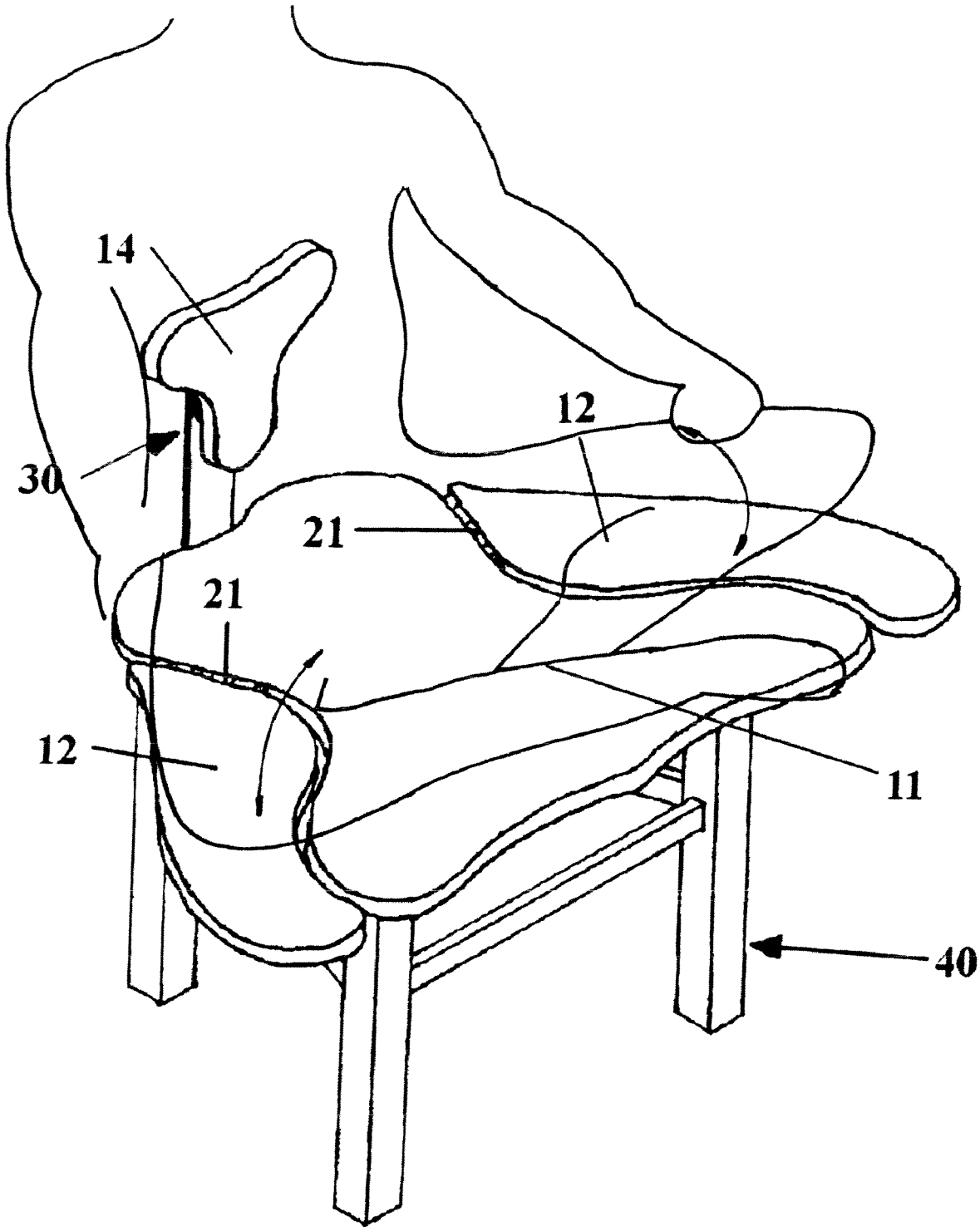
FIG. 1 is a perspective view of a seat in accordance with an embodiment of the present in invention connected to a base and showing an individual sitting in a cross-legged yoga position.
Figure 2:
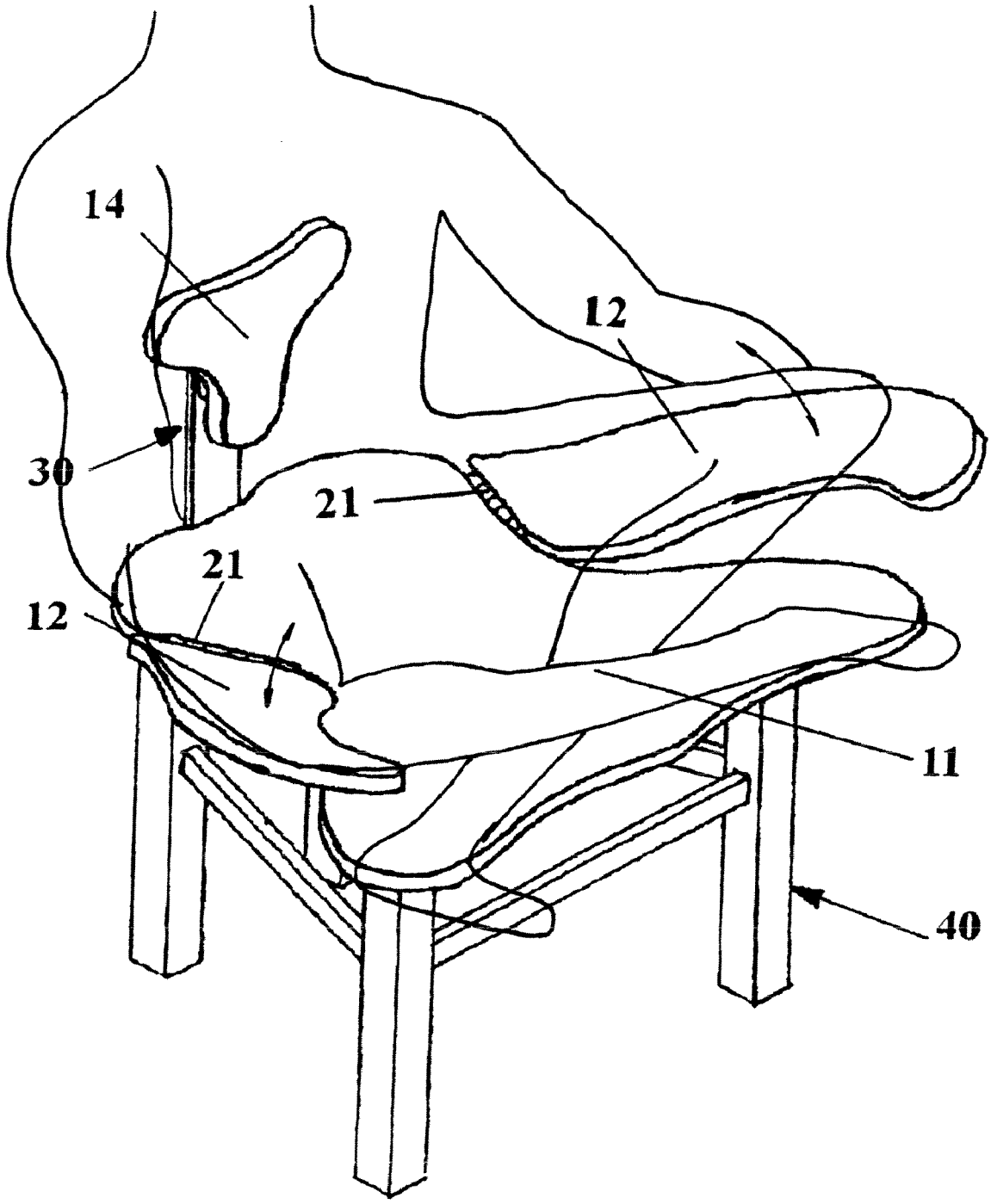
FIG. 2 is a perspective view of a seat having adjustable leg supports in accordance with an embodiment of the present invention, the seat connected to a base and showing an individual sitting in a cross-legged yoga position.
Figure 8:
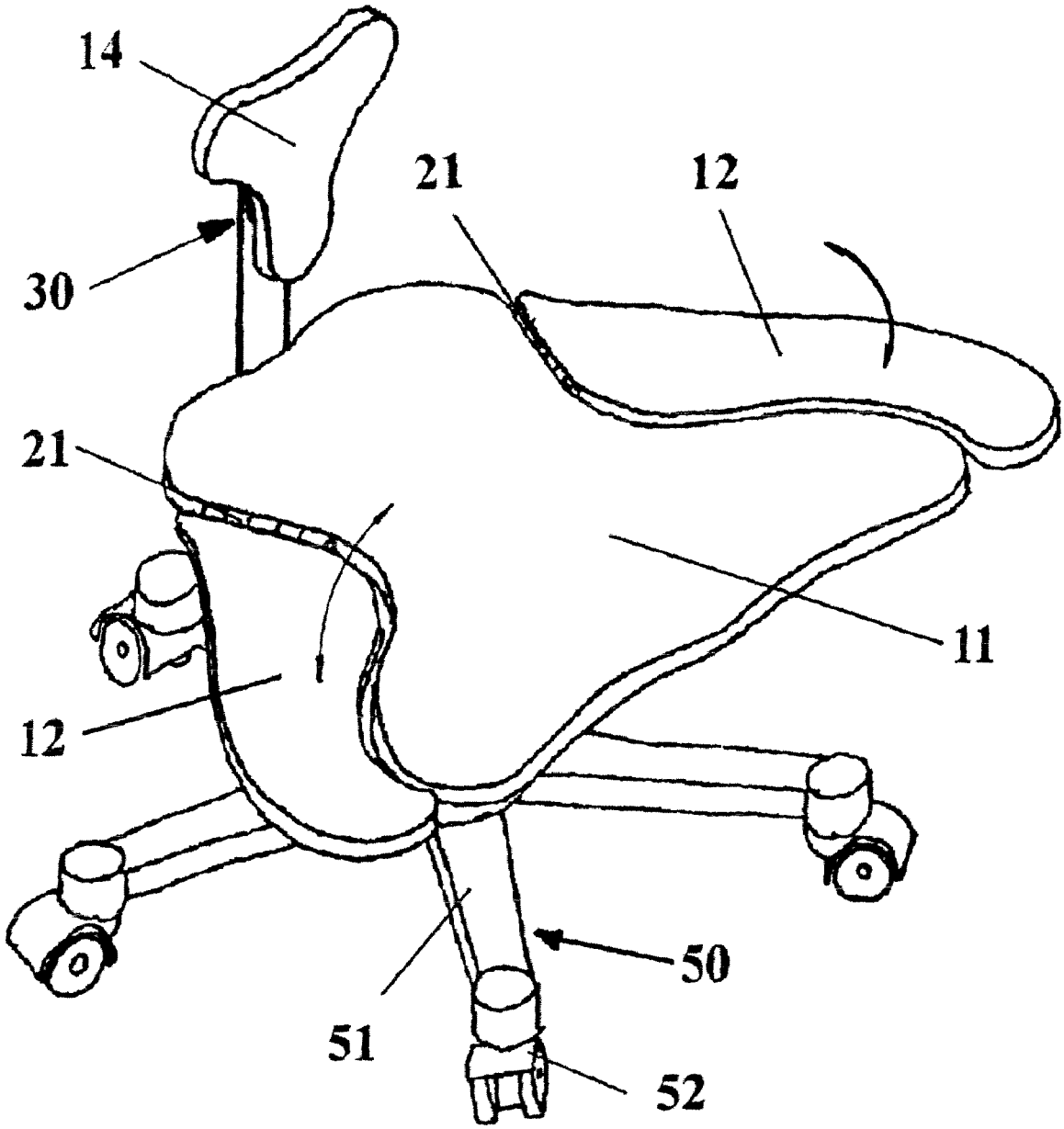
FIG. 8 is a perspective view of a seat in accordance with an embodiment of the present invention connected to an office chair base.
Figure 9:
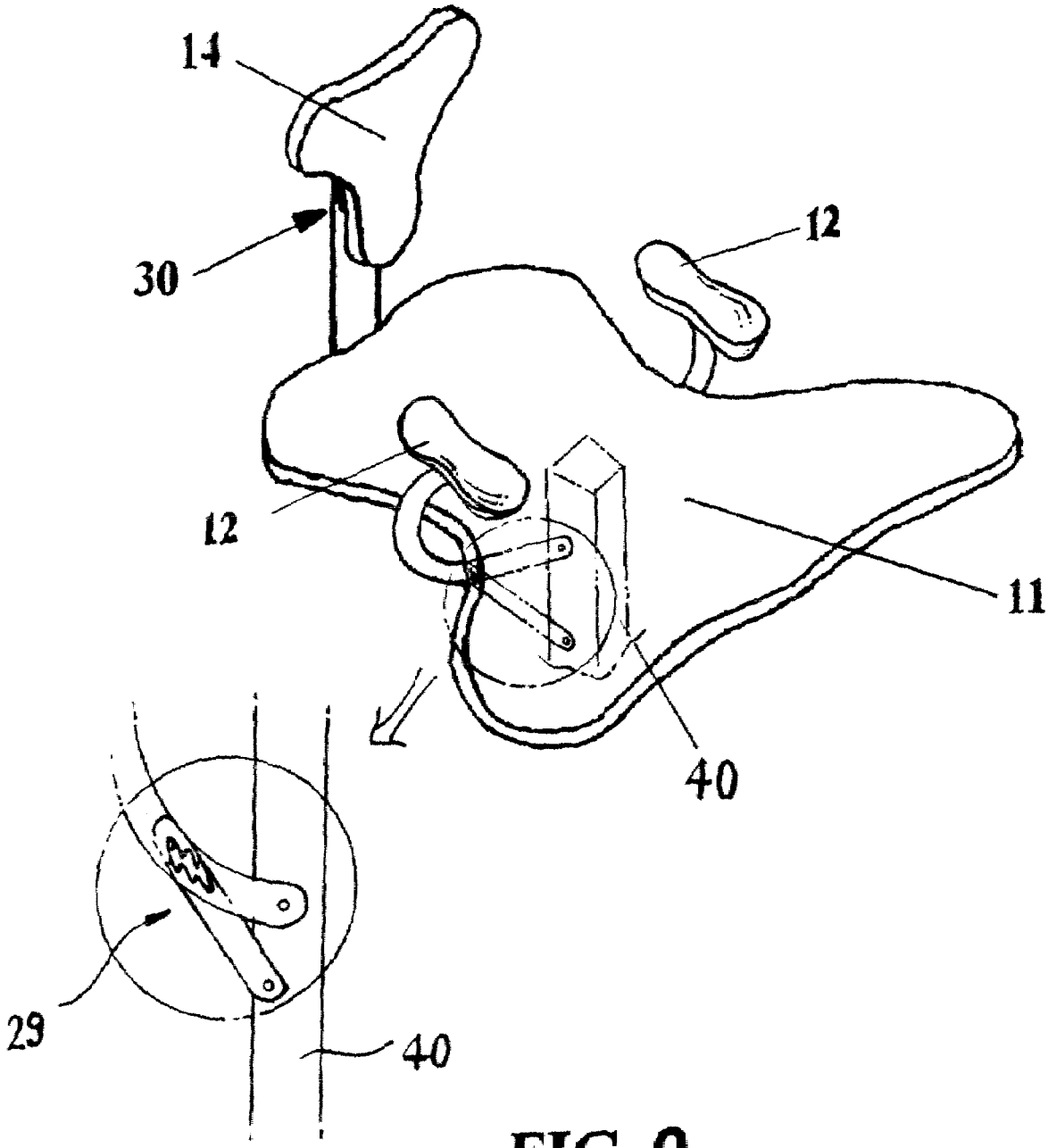
FIG. 9 is a perspective view of a seat and leg supports in accordance with an embodiment of the present invention.

As shown in FIGS. 1, 2, 8 and 9, the present invention generally includes a seat 11 having adjustable leg supports 12, with the seat 11 connected to a support base 40. Leg supports 12 may be hingedly connected to seat 11 (see FIGS. 1, 2 and 8) allowing for an arcing range of motion (as indicated by the arrows in FIG. 1) suitable for supporting a user's legs in any one of a variety of positions which are typical for a user sitting in a cross-legged position. Alternatively, as shown in FIG. 9, leg supports 12 may be connected to a support base 40 to provide for an arcing motion. FIG. 1 shows the leg supports 12 in a fully retracted position which is more typical for advanced yoga or meditation practitioners whose bodies are accustomed to sitting cross-legged without any thigh support or for users who are not taking advantage of the present invention's support of cross-legged seating by sitting in a conventional position. In operation, a user sits cross-legged on seat 11 and adjusts the leg supports 12 as required to change the position at which the user's legs will be supported to maximize the user's comfort level. Each leg support 12 is adjusted by pivoting the leg support, either about hinge 21, which is connected to the seat 11 (FIGS. 1, 2 and 8) or from the support base 40 (FIG. 9). In an alternate embodiment, the leg support 12 may be otherwise rotatably connected to the seat 11 for moving into any one of a plurality of positions arcing about its connection point to the seat 11. Once in a desired position, the leg supports 12 may be held in place using any mechanism (such as adjustable arm 25 shown in FIGS. 3 and 4) which is adjustable in length. FIG. 2 shows the leg supports 12 moved into an engaged position in which they would provide support for a cross-legged sitting user's thighs thereby enhancing such user's comfort. Generally the higher leg supports 12 are raised, the more comfort is offered for user's who are not used to sitting cross-legged.

Figure 3:
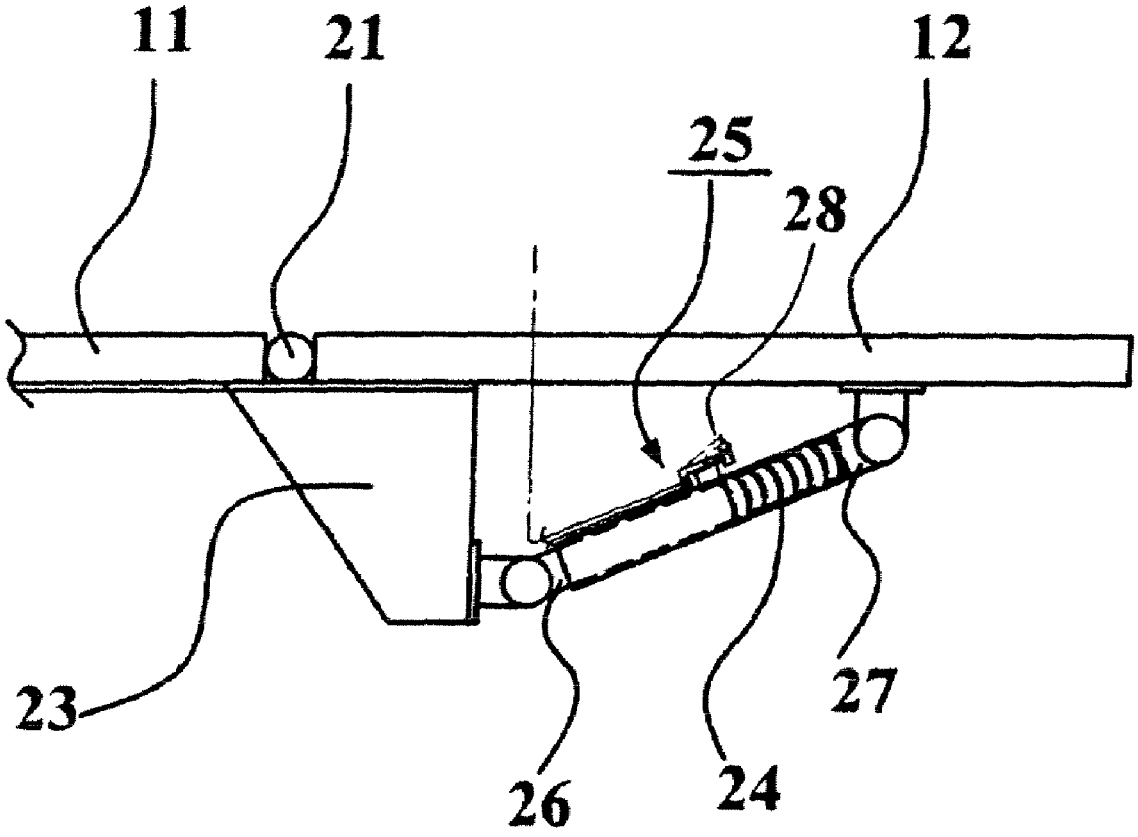
FIG. 3 is a side view of adjustable leg supports in accordance with an embodiment of the present invention.
Figure 4:
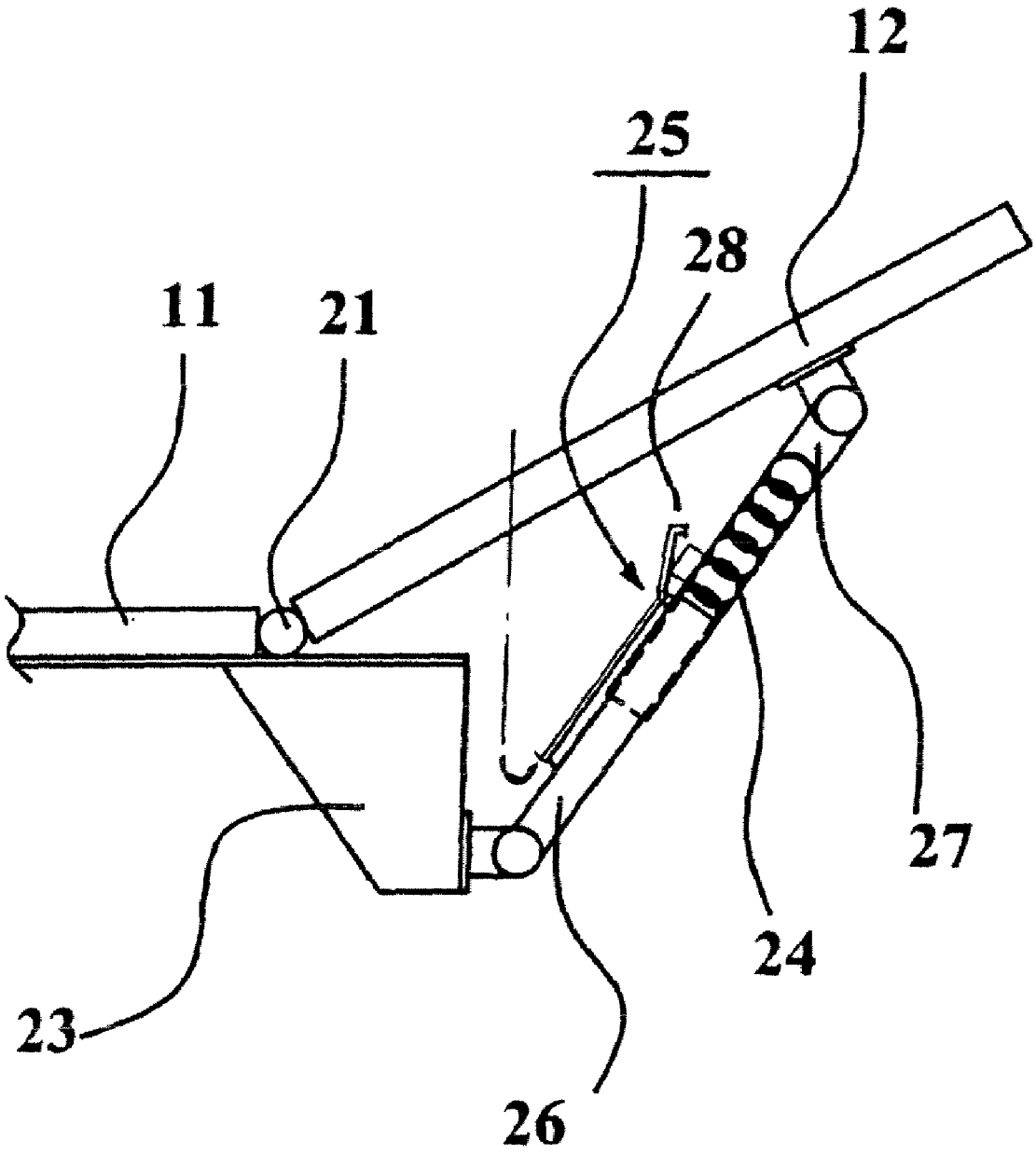
FIG. 4 is a side view of adjustable leg supports in accordance with an embodiment of the present invention.
Figure 5:
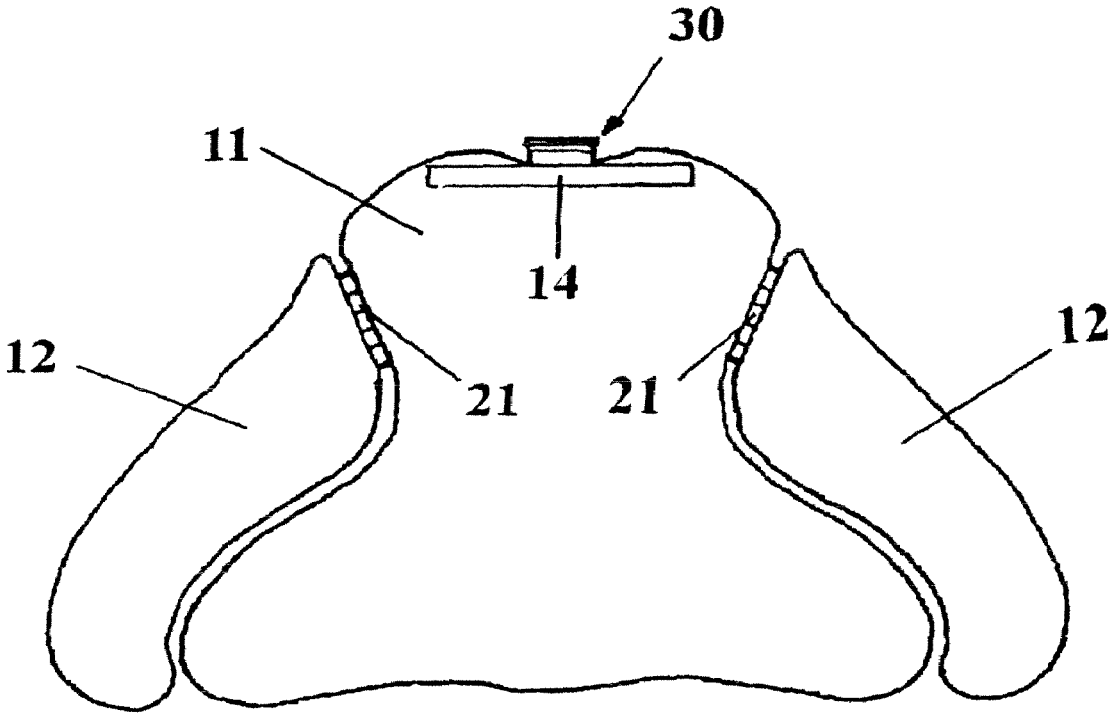
FIG. 5 is a top view of a seat and leg supports in accordance with an embodiment of the present invention.

As shown in FIGS. 3 and 4, the leg supports 12 may each be connected to the seat 11 by an adjustable arm 25 to allow the leg supports 12 to be adjusted by the user. The adjustable arm 25 includes an arm slider 26 and a receptacle 27. An arm slider 26 and receptacle 27 are hingedly mounted between the seat 11 and each of the leg supports 12. Alternatively, the arm slider 26 and receptacle 27 may be hingedly mounted on a bracket 23 which is attached to the seat 11 and each of the leg supports 12. The bracket 23 is adapted to ensure a strong connection between the seat 11 and each of the leg supports 12 to increase the support for the leg supports 12 and to allow the leg supports 12 to be raised higher. The bracket 23 also allows the adjustable arm 25 to adjust smoothly through the full range of motion allowing for abroad range of angles for the leg supports 12, in particular when near-flat or at low relative angles to the seat 11. Alternatively, the arm slider 26 and receptacle 27 may be mounted between the support base 40 and each of the leg supports 12. Alternatively, bracket 23 described above may be attached to support base 40 rather than seat 11. As shown in FIG. 9, alterate means of locking the adjustable leg supports 12 may be used such as a ratchet and locking system 29.

In one embodiment, the receptacle 27 includes an elastic spring 24 which compresses and extends depending upon the weight placed upon leg supports 12. In operation, when a user sits cross-legged on seat 11, the leg supports 12 are loaded from the weight of the user's legs, which then apply downward pressure on the adjustable arm 25. As a result, the arm slider 26 slides into the receptacle 27 and compresses the elastic spring 24. When the user gets off the seat 11, the arm slider 26 slides out of receptacle 27 by the restoration force of elastic spring 24. Therefore, the user leg supports 12 allow the user to adjust the position of the leg supports 12 independently of each other. The leg supports 12 can be positioned anywhere from between 0 (where the leg supports are parallel with the seat) to about 50 degrees (or more) relative to the plane of the seat 11. The arm slider 26 and the receptacle 27 also may be operated by an air pressure system, an oil pressure system, a hydraulic system or any other appropriate mechanism (whether mechanical or electrical) known to those skilled in the art.

The adjustable arm 25 may also include a locking device 28 (such as the locking device shown in U.S. Pat. No. 3,874,480 which is herein incorporated by reference) for allowing a user to lock the leg supports 12 in a stable position based upon the desired thigh support when sitting in a cross-legged position. To adjust the leg supports 12, a user unlocks the locking device and lifts the leg supports 12 to desired position. A user then locks the locking device to secure the adjustable arm 25 to prevent movement to the leg supports 12.

One skilled in the art will appreciate that leg supports 12 may include a biasing system to support the user's legs without the need for the adjustable arms 25 (and accompanying parts) or may otherwise incorporate load-bearing means to eliminate the requirement for adjustable arms 25.

Figure 6:
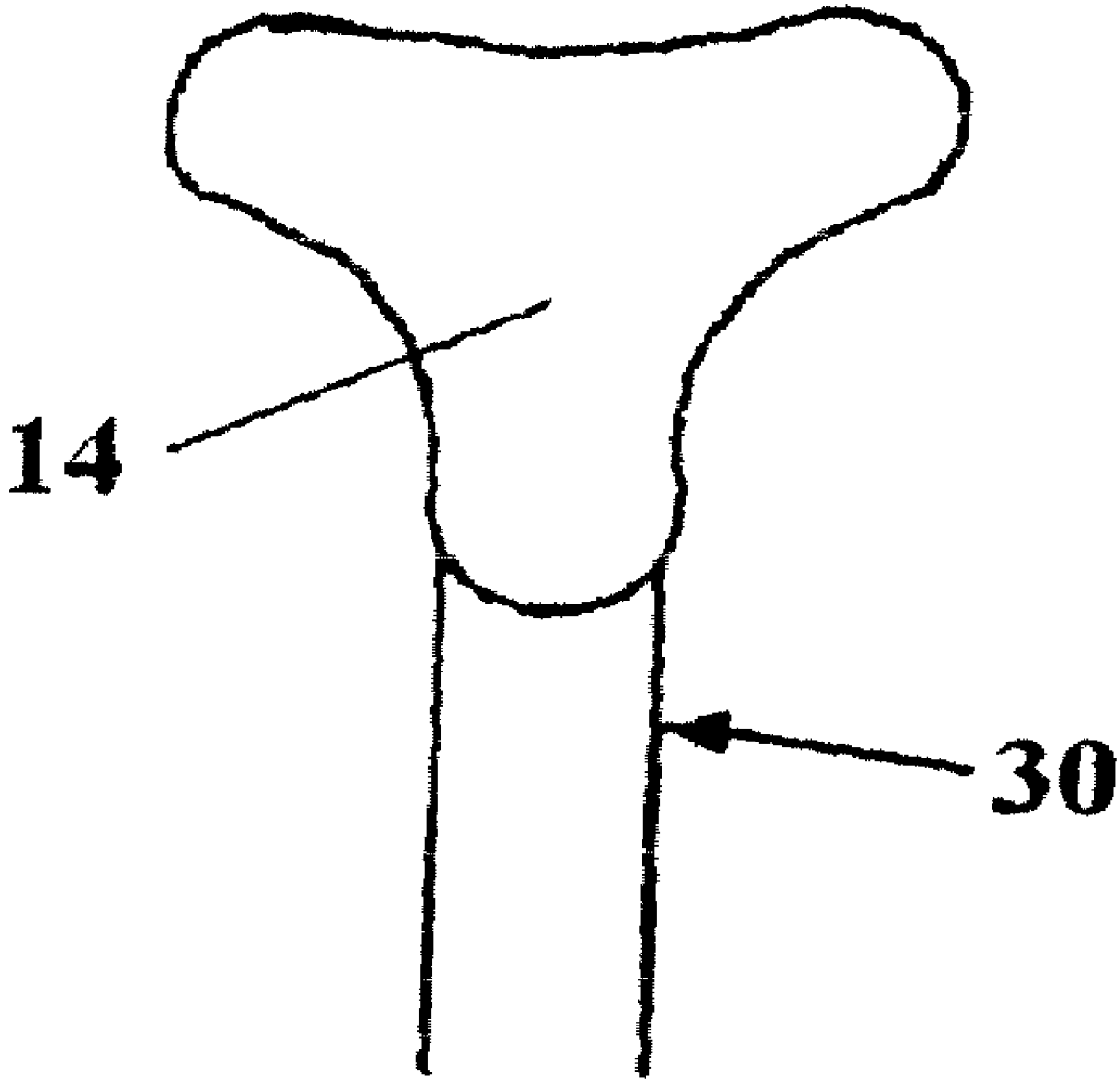
FIG. 6 is a front view of a back support in accordance with an embodiment of the present invention.
Figure 7:
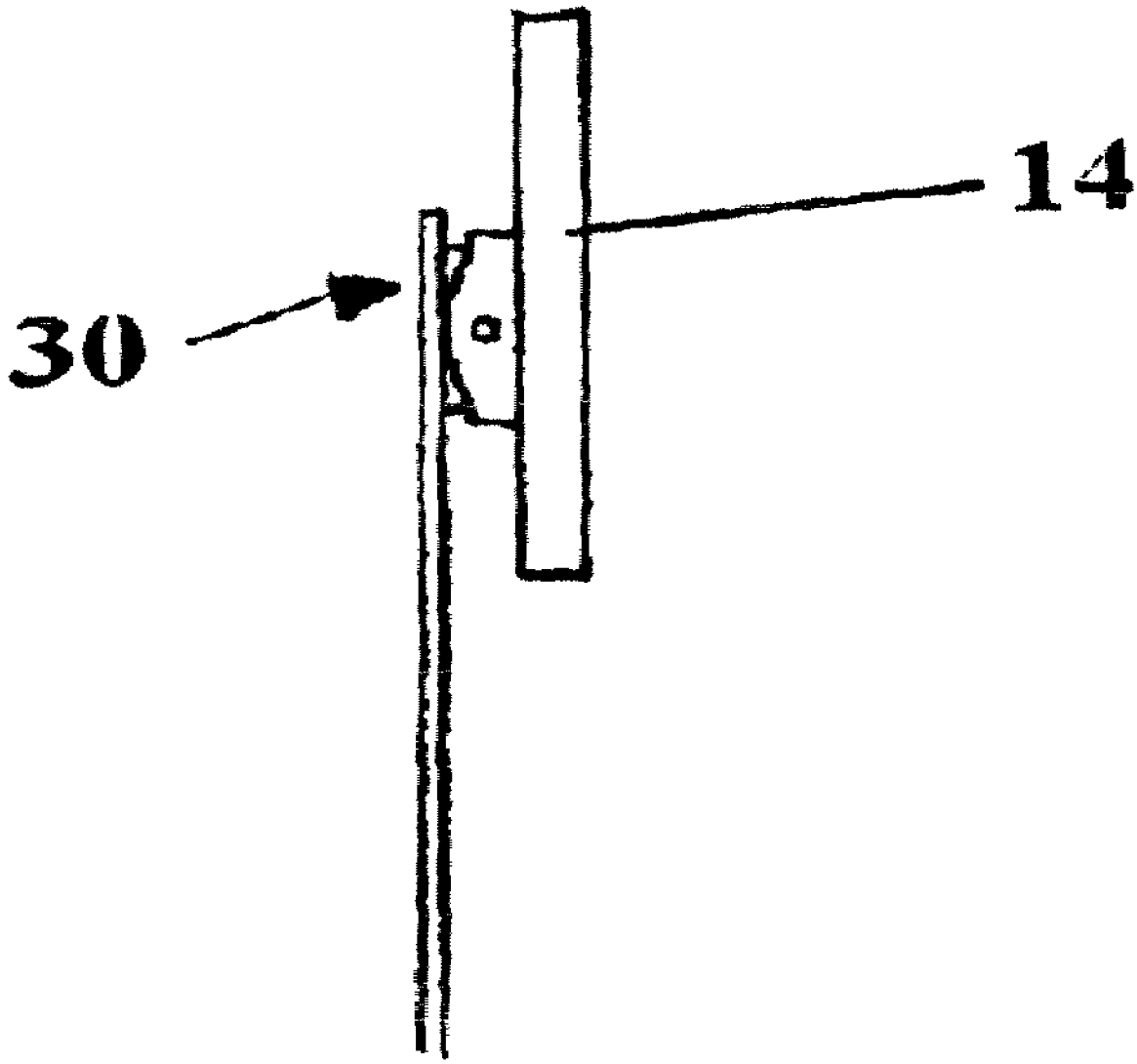
FIG. 7 is a side view of a back support in accordance with an embodiment of the present invention.

In one embodiment of the present invention as illustrated in FIGS. 6 to 8, the seat 11 may include a lower back support 30. The back support 30 is connected to the seat 11. The top of the back support 30 consists of a back rest 14 for supporting a user's back. The back rest 14 is hingedly connected to the back support 30 to allow adjustment to increase the user's comfort level. The back support 30 also may have a shape for aligning the pelvic bone with the rest of the user's spinal column for maximizing the postural benefits of sifting in the present invention.

In any of the above embodiments, seat 11 may have a particular shape to both cross-legged and conventional seating positions. In one embodiment shown in FIGS. 1, 2 and 8, seat 11 tapers inward from the rear of the seat to accommodate the leg supports 12 and then curves outward near the front to accommodate a user's feet while sitting in a cross-legged position. Further, the front of seat 11 may have contours which are meant to allow room for a user's legs when sitting in a conventional manner on the chair such that a user may take advantage of the back support 30.

In any of the above embodiments, the surface of the seat 11, leg supports 12 and the lower back support 30 may be optionally padded with foam, padding or other usual seating material (including mesh), and then optionally covered with suitable upholstery (not shown).

In any of the above embodiments, a suitable support base 40 may be any conventional chair base of a suitable height for environments where chair is use is typical in North America, such as an office chair base or a wooden chair base. For example, as illustrated in FIG. 8, one embodiment of support base 40 namely office chair base 50, is a type typically found on office chairs. More specifically, the office chair base 50 includes a stem (not shown) and a floor base 51. The floor base 51 may include wheels 52 for providing mobility. The stem may be height adjustable to ensure that the chair can be adjusted to a height suitable for different environments or different users, and may also include a variety of other ergonomic features known in the art (such as supporting the amount of recline of the present invention and the ease with which the chair can be reclined by a user).

One skilled in the art will appreciate that support base 40 may also be any other base suitable for supporting a seat 11. For example, many restaurants have bench or booth seating (not shown). Seat 11 and adjustable leg supports 12 could be placed upon and connected to such a bench or upon the base normally provided for booths, thereby allowing a user to take advantage of cross-legged seating as supported by adjustable leg supports 12. Such bench seating could be extended to bleacher seating (not shown) thereby allowing a large group of people to sit comfortably cross-legged, each user being able to individually adjust the position of their adjustable leg supports 12. In some cases, seats are simply supported by a stem structure which are connected to support a plurality of chairs, such as in an airport or in a theatre. The present invention extends to uses in such applications as well by allowing such stem or other similar support structure to serve as the support 40 for seat 11 or simply attaching seat 11 to such pre-existing base. In another embodiment, seat 11 may be attached to other furniture typically used for seating or may include a base 40 to comprise such furniture. For example, much as in the case of bench seating above, a plurality of seats 11 may be placed upon a base to provide a couch structure or a single seat 11 may be places upon a base to form an armchair or recliner. In the couch embodiment, the leg supports 12 may recess into the couch to improve the couch's aesthetic appeal when the leg supports 12 are not being used. In any of the above embodiments, the present invention may include the support base 40 rather than providing a seat 11 for placement on an existing or available support base 40.

While the above embodiments are directed to supporting a user while sitting in a cross-legged position, a user (or a different user using the same seat) may also sit in a conventional position. As mentioned above, this may be supported by contouring the front of the seat, Even without such contours, the chair is at a conventional height and may have comfort-enhancing features such as a back support 30 to increase the comfort of conventional seating. The ability of the present invention to support two different seating positions overcomes the limitation of prior art yoga chairs which, through their customized yoga sitting and un-adjustable design do not support conventional seating. Such versatility is valuable in environments where different users are using the chairs and may prefer to sit in either one of the two positions offered by the present invention. To further enhance such versatility, in an optional embodiment, the leg supports 12 may be easily removable to support users who rarely sit in a cross-legged position.

One skilled in the art will appreciate that although the figures illustrate a particular size and shape for the seat 11 and the leg supports 12 (as well as other elements), such size and shape may vary to accommodate different manufacturing, costs, aesthetic and other design and marketing considerations. By way of illustration only, the leg supports 12 may be much smaller in size to reduce the overall invention's size, such as in the embodiment shown in FIG. 9.

One skilled in the art will appreciate that while the leg supports 12 are shown in a particular arrangement in the figures, a broader variety of possible positions and connections are possible which would suitably provide adjustable leg supports. As indicated above, in one embodiment, the leg supports 12 may be connected to a support base 40 rather than to seat 11.

The embodiments of the present invention described above are intended to be examples only. Alterations, modifications and variations may be effect to the particular embodiments by those of skill in the art without departing from the scope of the invention.

What is claimed is:

1. A seating device for supporting a user sitting in a cross-legged yoga position comprising:

(a) a seat having a surface area wide enough to allow the user to sit on the seat in the cross-legged yoga position;

(b) a base operatively connected to the seat for supporting the seat; and (c) two adjustable leg supports, the two adjustable leg supports connected on opposite sides of the seat, each leg support for supporting one of the user's legs when the user sits on the seat in the cross-legged yoga position, the each adjustable leg support capable of adjustment to any one of a plurality of support positions as the each adjustable leg support arcs inward towards the center of the seat about a hinge connected between the adjustable leg support and the seat; and (d) two adjusting mechanisms, each adjusting mechanism for supporting one ajustable leg support in the plurality of adjustable leg support positions, where a first end of the each adjusting mechanism is connected to an underside and outside edge of the seat in a first location proximate to the adjustable leg support which is on the same side of the seat as the each adjusting mechanism, and where a second end of the each adjusting mechanism is directly connected to an underside of the adjustable leg support on the same side of the seat as the each adjusting mechanism in a second location which is on an outer edge of the adjustable leg support which is distal from the hinge, the first location of the connection of the first end of the each adjusting mechanism and the second location of the connection of the second end of the each adjusting mechanism for ensuring weight-bearing support for the adjustable leg support and for maximizing the range of motion of the adjustable leg support.

2. The device as in claim 1 wherein the base is a regular chair base with a plurality of legs.

3. The device as in claim 1 wherein the base has a stem for adjusting the height of the seat and a floor base having wheels for providing mobility.

4. The device as in claim 1 wherein the each adjusting mechanism consists of an arm slider and receptacle.

5. The device as in claim 4 wherein the receptacle includes an elastic spring system for reciprocating the slider.

6. The device as in claim 4 wherein the receptacle includes an air pressure system for reciprocating the slider.

7. The device as in claim 4 wherein the receptacle includes an oil pressure system for reciprocating the slider.

8. The device as in claim 4 wherein the receptacle includes a hydraulic pressure system for reciprocating the slider.

9. The device as in claim 1 wherein the each adjusting mechanism includes a locking device for fixing the leg support on the same side as the each adjusting mechanism into one of the plurality of support positions.

10. A seating device for supporting a user sitting in either one of a cross-legged yoga position or a conventional chair seating position comprising:

(a) a seat having a surface area wide enough to allow the user to sit on the seat in the cross-legged yoga position, the seat further having contours in the front of the seat to allow a user to sit on the seat in a conventional chair seating position;

(b) a base operatively connected to the seat for supporting the seat; and (c) two adjustable leg supports, each leg support connected on either side of the seat, the each leg support for supporting one of the user's legs when the user sits in the cross-legged yoga position on the seat, the each adjustable leg support capable of adjustment to any one of a plurality of positions arcing inward about a hinge connected between the adjustable leg support and the seat; and (d) two adjusting mechanisms, each adjusting mechanism for supporting one adjustable leg support in the plurality of adjustable leg support positions, where a first end of the each adjusting mechanism is connected to an underside and outside edge of the seat in a first location proximate to the adjustable leg support which is on the same side of the seat as the each adjusting mechanism, and where a second end of the each adjusting mechanism is directly connected to an underside of the adjustable leg support on the same side of the seat as the each adjusting mechanism in a second location which is on an outer edge of the adjustable leg support which is distal from the hinge, the first location of the connection of the first end of the each adjusting mechanism and the second location of the connection of the second end of the each adjusting mechanism are for ensuring weight-bearing support for the adjustable leg support and for maximizing the range of motion of the adjustable leg support.

11. The device as in claim 10 for supporting a user sitting in the cross-legged yoga position, wherein the seat has a front portion and a rear portion, and wherein the device further comprises a back support hingedly connected to the rear portion of the seat.

12. The device as in claim 11 wherein the back support includes an adjustable back rest for supporting a user's back.

13. The device as in claim 10 further comprising a bracket attached to the underside and outside edge of the seat for supporting the end of the each adjusting mechanism which is connected to the seat.

14. A seat for operative connection to a support base, the seat for supporting a user sitting in a cross-legged yoga position comprising:

(a) a surface area wide enough to allow the user to sit in the cross-legged yoga position; and (b) adjustable leg supports connected to the seat, each adjustable leg support for moving into any one of a plurality of positions pivoting inward towards the center of the seat about its pivot connection point to the seat; and (c) two adjusting mechanisms, each adjusting mechanism for supporting one adjustable leg support in the plurality of adjustable leg support positions, where a first end of the each adjusting mechanism is connected to an underside and outside edge of the seat in a first location proximate to the adjustable leg support which is on the same side of the seat as the each adjusting mechanism, and where a second end of the each adjusting mechanism is directly connected to an underside of the adjustable leg support on the same side of the seat as the each adjusting mechanism in a second location which is on an outer edge of the adjustable leg support which is distal from the pivot connection point, the first location of the connection of the first end of the each adjusting mechanism and the second location of the connection of the second end of the each adjusting mechanism are for ensuring weight-bearing support for the adjustable leg support and for maximizing the range of motion of the adjustable leg support.

15. A method for allowing a user to sit in a cross-legged yoga position comprising the steps of:

(a) providing the user with a seating device including a seat having a surface area wide enough to allow a user to sit on the seat in the cross-legged yoga position;

(b) providing adjustable leg supports each connected to either side of the seat for providing support for each of the user's legs while the user sits in the cross-legged yoga position on the seat, each of the leg adjustable supports arcing inward about a hinge connected between each of the adjustable leg supports and the seat and (c) two adjusting mechanisms, each adjusting mechanism for supporting one adjustable leg support in a plurality of adjustable leg support positions, where a first end of the each adjusting mechanism is connected to an underside and outside edge of the seat in a first location proximate to the adjustable leg support which is on the same side of the seat as the each adjusting mechanism, and where a second end of the each adjusting mechanism is directly connected to an underside of the adjustable leg support on the same side of the seat as the each adjusting mechanism in a second location which is on an outer edge of the adjustable leg support which is distal from the hinge, the first location of the connection of the first end of the adjusting mechanism and the second location of the connection of the second end of the adjusting mechanism are for ensuring weight-bearing support for the adjustable leg support and for maximizing the range of motion of the adjustable leg support.

16. A seating device for supporting a user sitting in a cross-legged yoga position comprising:

(a) a seat having a surface area wide enough to allow the user to sit on the seat in the cross-legged yoga position;

(b) a base operatively connected to the seat for supporting the seat;

(c) two adjustable leg supports, the two adjustable leg supports connected on opposite sides of the seat, the each leg support for supporting one of the user's legs when the user sits on the seat in the cross-legged yoga position, the each adjustable leg support capable of adjustment to any one of a plurality of support positions as the each adjustable leg support arcs inward towards the centre of the seat about a hinge connected between the adjustable leg support and the seat; and (d) two adjusting mechanisms, each adjusting mechanism for supporting one adjustable leg support in the plurality of adjustable leg support positions, where a first end of the each adjusting mechanism is connected to an underside and outside edge of the seat in a first location proximate to the adjustable leg support which is on the same side of the seat as the each adjusting mechanism, and where a second end of the each adjusting mechanism is directly pivotally connected to an underside of the adjustable leg support on the same side of the seat as the each adjusting mechanism on an outer edge outer edge of the adjustable leg support which is distal from the hinge, the first location of the connection of the first end of the each adjusting mechanism and the second location of the connection of the second end of the each adjusting mechanism are for ensuring weight-bearing support for the adjustable leg support and for maximizing the range of motion of the adjustable leg support.

US 7,8,455 B2
9 10

* * * * *

UNITED STATES PATENT AND TRADEMARK OFFICE

CERTIFICATE OF CORRECTION

PATENT NO. : 7,628,455 B2
APPLICATION NO. : 11/588535
DATED : December 8, 2009
INVENTOR(S) : Carl Christopher Brodeur It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 0 days.

Signed and Sealed this

Second Day of November, 2010

David J. Kappos

David J. Kappos
*Director of the United States Patent and Trademark Office*